US011121469B2

(12) United States Patent
Paulotto et al.

(10) Patent No.: US 11,121,469 B2
(45) Date of Patent: Sep. 14, 2021

(54) MILLIMETER WAVE ANTENNAS HAVING CONTINUOUSLY STACKED RADIATING ELEMENTS

(71) Applicant: Apple Inc., Cupertino, CA (US)

(72) Inventors: Simone Paulotto, Redwood City, CA (US); Jennifer M. Edwards, San Francisco, CA (US); Harish Rajagopalan, San Jose, CA (US); Bilgehan Avser, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/584,067

(22) Filed: Sep. 26, 2019

(65) Prior Publication Data

US 2021/0098882 A1 Apr. 1, 2021

(51) Int. Cl.

| | |
|---|---|
| ***H01Q 21/06*** | (2006.01) |
| ***H01Q 9/04*** | (2006.01) |
| ***H01Q 21/22*** | (2006.01) |
| ***H01Q 1/24*** | (2006.01) |
| ***H01Q 1/48*** | (2006.01) |

(52) U.S. Cl.

CPC ..... *H01Q 9/0414* (2013.01); *H01Q 1/243* (2013.01); *H01Q 1/48* (2013.01); *H01Q 21/065* (2013.01); *H01Q 21/22* (2013.01)

(58) Field of Classification Search

CPC ..... H01Q 1/243; H01Q 9/0414; H01Q 21/065

See application file for complete search history.

(56) References Cited

U.S. PATENT DOCUMENTS

| | | | |
|---|---|---|---|
| 6,249,256 | B1 | 6/2001 | Luxon et al. |
| 6,888,502 | B2 | 5/2005 | Beigel et al. |

(Continued)

FOREIGN PATENT DOCUMENTS

| | | | |
|---|---|---|---|
| EP | 2797168 | B1 | 4/2019 |
| JP | 2017085289 | A | 5/2017 |
| KR | 101014347 | B1 | 2/2011 |

OTHER PUBLICATIONS

Bilgehan Avser et al., U.S. Appl. No. 16/146,705, filed Sep. 28, 2018.

*Primary Examiner* — Hasan Islam

(74) *Attorney, Agent, or Firm* — Treyz Law Group, P.C.; Michael H. Lyons; Tianyi He

(57) ABSTRACT

An electronic device may be provided with a phased antenna array. The array may convey signals greater than 10 GHz and may be formed on a substrate having transmission line layers and antenna layers. An antenna in the array may have a radiating element that includes first, second, and third overlapping patch elements on the antenna layers. The antenna may be fed using a differential transmission line coupled to a differential feed on the first patch element. The differential transmission line may include first and second signal traces. A first via may couple the first signal trace to the first, second, and third patch elements. A second via may couple the second signal trace to the first, second, and third patch elements. The patch elements may introduce capacitances to the radiating element that help to compensate for inductances associated with the distance between the radiating element and the signal traces.

20 Claims, 10 Drawing Sheets

(56) References Cited

U.S. PATENT DOCUMENTS

| | | | | |
|---|---|---|---|---|
| 7,079,079 | B2 * | 7/2006 | Jo | H01Q 1/243 343/700 MS |
| 7,486,156 | B2 | 2/2009 | Lee et al. | |
| 7,595,759 | B2 | 9/2009 | Schlub et al. | |
| 8,102,330 | B1 | 1/2012 | Albers | |
| 9,478,873 | B2 | 10/2016 | Balbien et al. | |
| 10,056,688 | B2 | 8/2018 | Andresen et al. | |
| 10,320,079 | B2 | 6/2019 | Castany et al. | |
| 10,320,089 | B2 | 6/2019 | Jakoby et al. | |
| 10,411,505 | B2 | 9/2019 | Shao et al. | |
| 10,727,580 | B2 * | 7/2020 | Rajagopalan | H01Q 9/045 |
| 10,734,332 | B2 * | 8/2020 | Lasiter | H01L 23/49827 |
| 10,741,906 | B2 * | 8/2020 | Angulo | H01Q 1/525 |
| 2002/0149520 | A1 * | 10/2002 | Laubner | H01Q 21/30 343/700 MS |
| 2005/0110685 | A1 | 5/2005 | Toit | |
| 2006/0267844 | A1 | 11/2006 | Yanagi et al. | |
| 2008/0316121 | A1 | 12/2008 | Hobson et al. | |
| 2014/0203995 | A1 | 7/2014 | Romney et al. | |
| 2014/0210486 | A1 | 7/2014 | Dijkstra | |
| 2015/0194730 | A1 | 7/2015 | Sudo et al. | |
| 2015/0333407 | A1 | 11/2015 | Yamagajo et al. | |
| 2017/0256867 | A1 | 9/2017 | Ding et al. | |
| 2018/0198204 | A1 | 7/2018 | Kovacic | |
| 2019/0020114 | A1 * | 1/2019 | Paulotto | H01Q 9/0442 |
| 2019/0319364 | A1 * | 10/2019 | Yang | H01Q 21/28 |

* cited by examiner

MILLIMETER WAVE ANTENNAS HAVING CONTINUOUSLY STACKED RADIATING ELEMENTS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. In order to support millimeter and centimeter wave communications, an array of antennas is formed on a substrate. Transmission lines for the array are embedded within the substrate.

Operation at these frequencies may support high bandwidths but may raise significant challenges. For example, it can be difficult to ensure that transmission lines on the substrate are sufficiently isolated from each other, particularly as the number of antennas in the array increases. At the same time, manufacturers are continually striving to implement wireless communications circuitry such as antenna arrays using compact structures to satisfy consumer demand for small form factor wireless devices.

It would therefore be desirable to be able to provide electronic devices with improved wireless communications circuitry such as communications circuitry that supports millimeter and centimeter wave communications.

SUMMARY

An electronic device may be provided with wireless circuitry. The wireless circuitry may include radio-frequency transceiver circuitry and a phased antenna array. The phased antenna array may convey radio-frequency signals in a signal beam at a frequency greater than 10 GHz.

The phased antenna array may be formed on a dielectric substrate having vertically-stacked dielectric layers. The dielectric layers may include transmission line layers and antenna layers stacked on the transmission line layers. Ground traces may separate the transmission line layers from the antenna layers. The phased antenna array may include antennas having antenna radiating elements formed on the antenna layers. Fences of conductive vias may be used to isolate the antennas in the phased antenna array from each other. The phased antenna array may be mounted against a dielectric cover layer (e.g., a housing wall for the device) and may radiate through the dielectric cover layer.

An antenna in the phased antenna array may have an antenna radiating element that includes first, second, and third patch elements formed from overlapping conductive traces on the antenna layers. The first patch element may be interposed between the ground traces and the second patch element. The second patch element may be interposed between the first and third patch elements. The antenna may include parasitic elements that are formed from conductive traces coplanar with one or more of the first, second, and third patch elements. The antenna may be fed using a differential radio-frequency transmission line path coupled to a differential antenna feed on the first patch element. The differential radio-frequency transmission line path may include first and second strip lines having first and second signal traces, as an example.

A first conductive via may be used to couple the first signal trace to the first, second, and third patch elements. For example, the first conductive via may include a first portion that couples the first signal trace to the first patch element, a second portion that is laterally-aligned with the first portion and that couples the first patch element to the second patch element, and a third portion that is laterally-aligned with the first and second portions and that couples the second patch element to the third patch element. A second conductive via may similarly be used to couple the second signal trace to the first, second, and third patch elements. In another suitable arrangement, a single-ended antenna feed may be used.

The first, second, and third patch elements may introduce capacitances to the antenna radiating element that help to compensate for excessive inductances associated with the distance between the antenna radiating element and the signal traces of the radio-frequency transmission line path. This may ensure that the antenna is impedance matched to the radio-frequency transmission line path. If desired, the phased antenna array may include an additional antenna with an additional antenna radiating element that is fed using an additional radio-frequency transmission line path. The additional radio-frequency transmission line path may be located closer to the additional antenna radiating element in the transmission line layers than the radio-frequency transmission line path used to feed the antenna. The additional antenna radiating element may include only a single patch element formed from a single layer of conductive traces. By distributing the radio-frequency transmission line paths across multiple transmission line layers, the phased antenna array may include a large number of antennas, may cover a large number of frequencies, and/or may cover a large number of polarizations while also exhibiting sufficient electromagnetic isolation between the radio-frequency transmission line paths.

DETAILED DESCRIPTION

Figure 1:
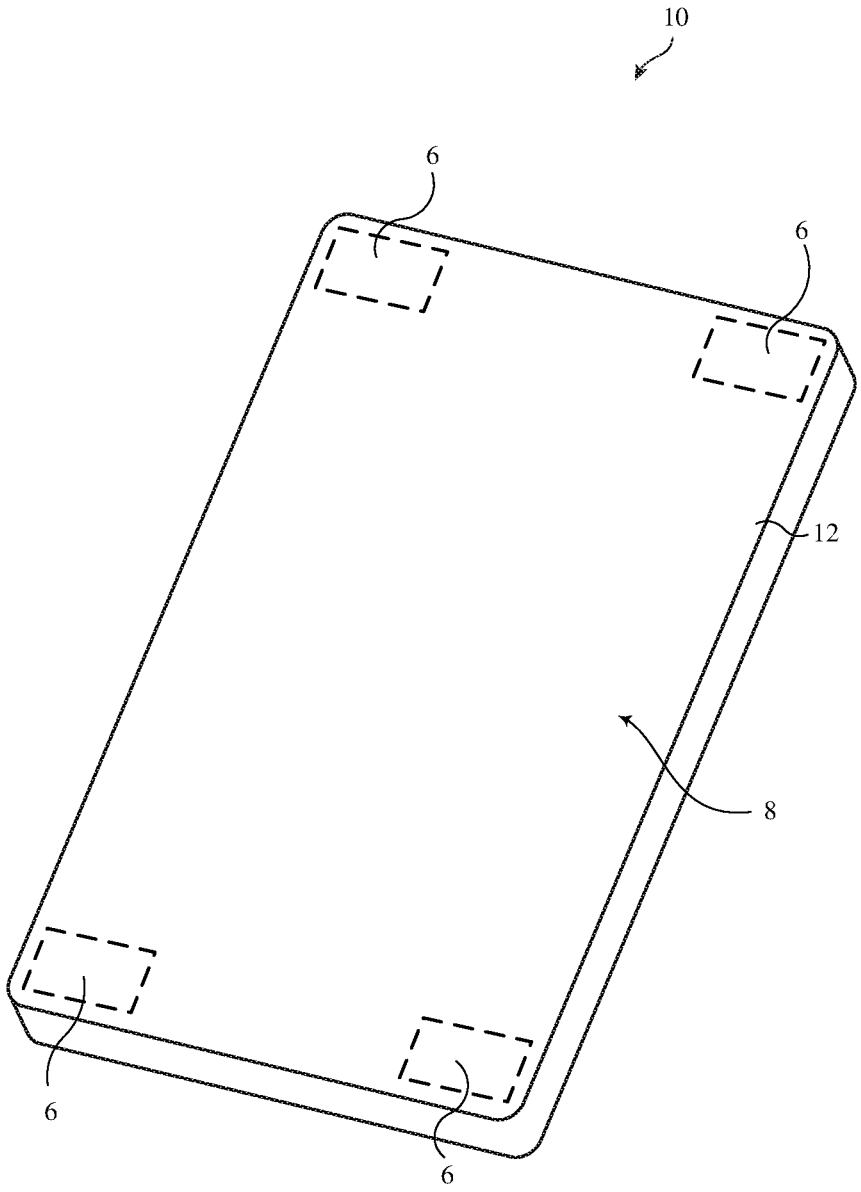
FIG. 1 is a front perspective view of an illustrative electronic device with wireless circuitry in accordance with some embodiments.

An electronic device such as electronic device 10 of FIG. 1 may contain wireless circuitry. The wireless circuitry may include one or more antennas. The antennas may include phased antenna arrays that are used for performing wireless communications and/or spatial ranging operations using millimeter and centimeter wave signals. Millimeter wave signals, which are sometimes referred to as extremely high frequency (EHF) signals, propagate at frequencies above about 30 GHz (e.g., at 60 GHz or other frequencies between about 30 GHz and 300 GHz). Centimeter wave signals propagate at frequencies between about 10 GHz and 30 GHz. If desired, device 10 may also contain antennas for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a portable speaker, a keyboard, a gaming controller, a gaming system, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, portable speaker, or other portable computing device. Other configurations may be used for device 10 if desired. The example of FIG. 1 is merely illustrative.

As shown in FIG. 1, device 10 may include a display such as display 8. Display 8 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 8 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch sensor electrodes may be formed from an array of indium tin oxide pads or other transparent conductive structures.

Display 8 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 8 may be protected using a display cover layer such as a layer of transparent glass, clear plastic, sapphire, or other transparent dielectrics. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that implement beam steering, etc.) may be mounted under an inactive border region of display 8 (see, e.g., illustrative antenna locations 6 of FIG. 1). Display 8 may contain an active area with an array of pixels (e.g., a central rectangular portion). Inactive areas of display 8 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 6 of FIG. 1 and/or in corner locations on the rear of housing 12), along the peripheral edges of housing 12, on the rear of housing 12, under the display cover glass or other dielectric display cover layer that is used in covering and protecting display 8 on the front of device 10, over a dielectric window on a rear face of housing 12 or the edge of housing 12, over a dielectric cover layer such as a dielectric rear housing wall that covers some or all of the rear face of device 10, or elsewhere in device 10.

Figure 2:
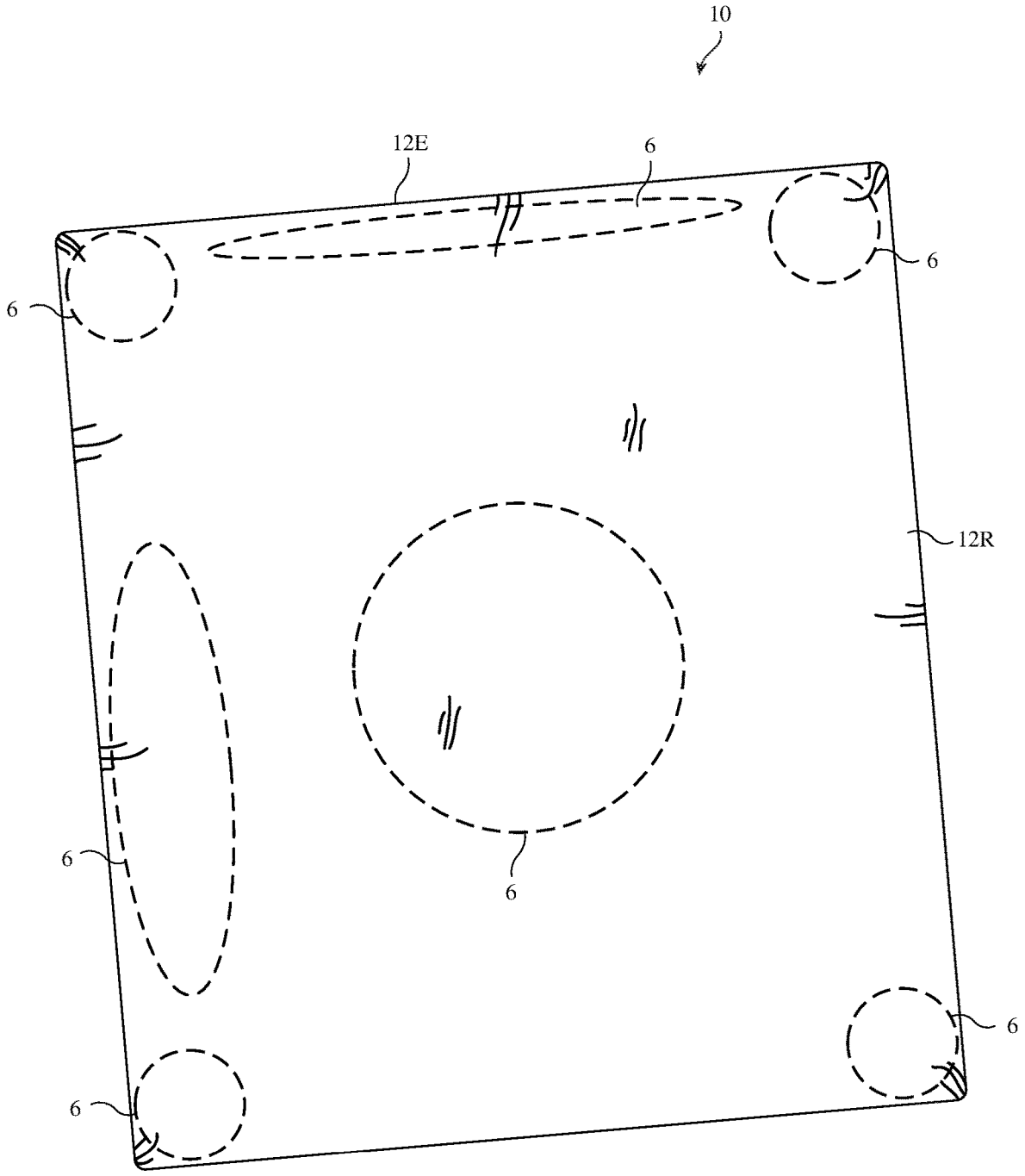
FIG. 2 is a rear perspective view of an illustrative electronic device with wireless circuitry in accordance with some embodiments.

FIG. 2 is a rear perspective view of electronic device 10 showing illustrative locations 6 on the rear and sides of housing 12 in which antennas (e.g., single antennas and/or phased antenna arrays) may be mounted in device 10. The antennas may be mounted at the corners of device 10, along the edges of housing 12 such as edges formed by sidewalls 12E, on upper and lower portions of rear housing wall 12R, in the center of rear housing wall 12R (e.g., under a dielectric window structure or other antenna window in the center of rear housing wall 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric (e.g., plastic, glass, sapphire, ceramic, fabric, etc.), the antennas may transmit and receive antenna signals through any suitable portion of the dielectric. In configurations in which housing 12 is formed from a conductive material such as metal, regions of the housing such as slots or other openings in the metal may be filled with plastic or other dielectrics. The antennas may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external wireless equipment from the antennas mounted within the interior of device 10 and may allow internal antennas to receive antenna signals from external wireless equipment. In another suitable arrangement, the antennas may be mounted on the exterior of conductive portions of housing 12.

FIGS. 1 and 2 are merely illustrative. In general, housing 12 may have any desired shape (e.g., a rectangular shape, a cylindrical shape, a spherical shape, combinations of these, etc.). Display 8 of FIG. 1 may be omitted if desired. Antennas may be located within housing 12, on housing 12, and/or external to housing 12.

Figure 3:
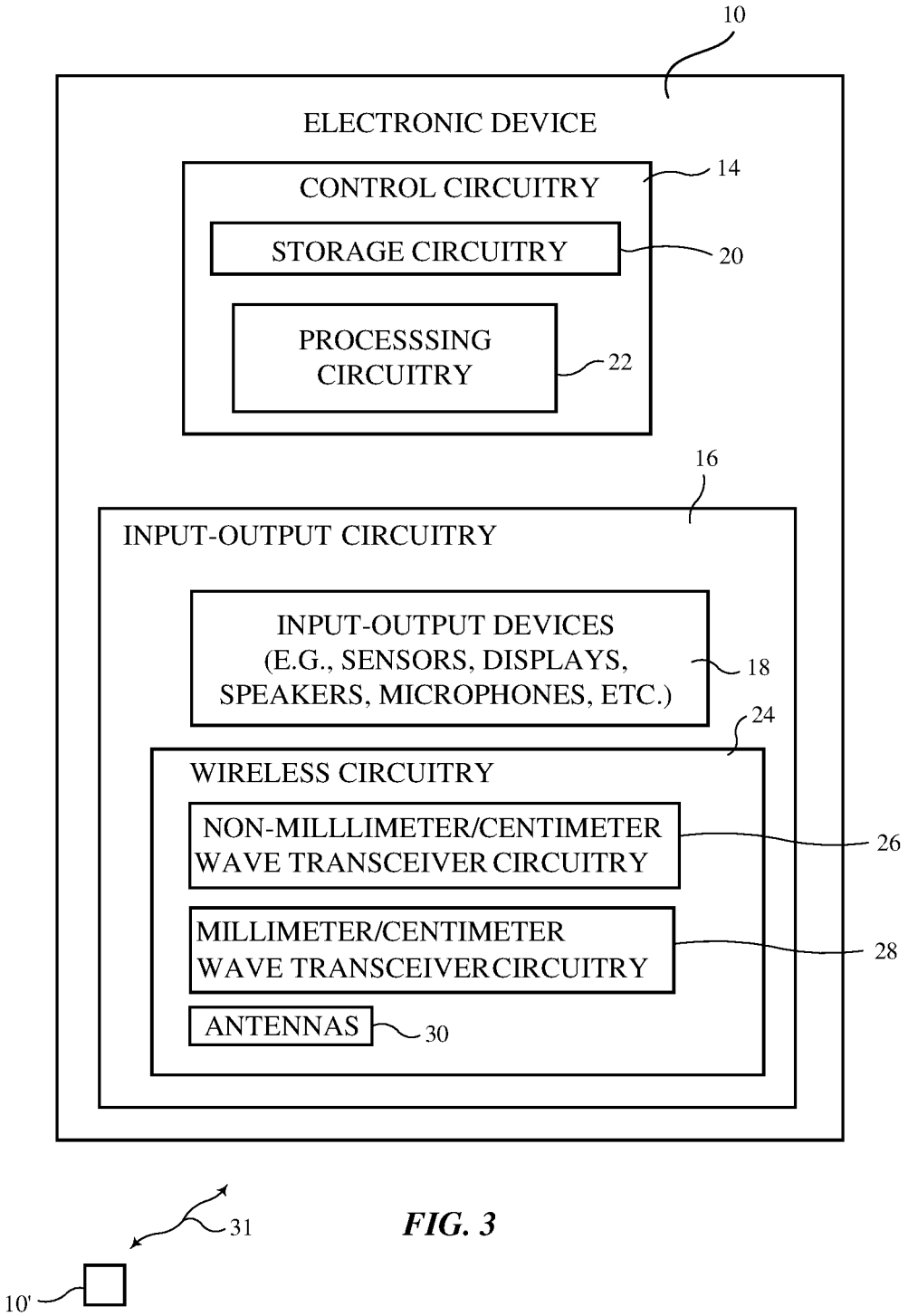
FIG. 3 is a schematic diagram of an illustrative electronic device with wireless circuitry in accordance with some embodiments.

A schematic diagram of illustrative components that may be used in device 10 is shown in FIG. 3. As shown in FIG. 3, device 10 may include control circuitry 14. Control circuitry 14 may include storage such as storage circuitry 20. Storage circuitry 20 may include hard disk drive storage, nonvolatile memory (e.g., flash memory or other electrically-programmable-read-only memory configured to form a solid-state drive), volatile memory (e.g., static or dynamic random-access-memory), etc. Control circuitry 14 may include processing circuitry such as processing circuitry 22. Processing circuitry 22 may be used to control the operation of device 10. Processing circuitry 22 may include on one or more microprocessors, microcontrollers, digital signal processors, host processors, baseband processor integrated circuits, application specific integrated circuits, central processing units (CPUs), etc. Control circuitry 14 may be configured to perform operations in device 10 using hardware (e.g., dedicated hardware or circuitry), firmware, and/or software. Software code for performing operations in device 10 may be stored on storage circuitry 20 (e.g., storage circuitry 20 may include non-transitory (tangible) computer readable storage media that stores the software code). The software code may sometimes be referred to as program instructions, software, data, instructions, or code. Software code stored on storage circuitry 20 may be executed by processing circuitry 22.

Control circuitry 14 may be used to run software on device 10 such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, antenna-based spatial ranging protocols (e.g., radio detection and ranging (RADAR) protocols or other desired range detection protocols for signals conveyed at millimeter and centimeter wave frequencies), etc. Each communication protocol may be associated with a corresponding radio access technology (RAT) that specifies the physical connection methodology used in implementing the protocol.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless circuitry such as wireless circuitry 24 for wirelessly conveying radio-frequency signals. While control circuitry 14 is shown separately from wireless circuitry 24 in the example of FIG. 3 for the sake of clarity, wireless circuitry 24 may include processing circuitry that forms a part of processing circuitry 22 and/or storage circuitry that forms a part of storage circuitry 20 of control circuitry 14 (e.g., portions of control circuitry 14 may be implemented on wireless circuitry 24). As an example, control circuitry 14 may include baseband processor circuitry or other control components that form a part of wireless circuitry 24.

Wireless circuitry 24 may include millimeter and centimeter wave transceiver circuitry such as millimeter/centimeter wave transceiver circuitry 28. Millimeter/centimeter wave transceiver circuitry 28 may support communications at frequencies between about 10 GHz and 300 GHz. For example, millimeter/centimeter wave transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, millimeter/centimeter wave transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, millimeter/centimeter wave transceiver circuitry 28 may support IEEE 802.11ad communications at 60 GHz and/or $5^{th}$ generation mobile networks or $5^{th}$ generation wireless systems (5G) communications bands between 27 GHz and 90 GHz. Millimeter/centimeter wave transceiver circuitry 28 may be formed from one or more integrated circuits (e.g., multiple integrated circuits mounted on a common printed circuit in a system-in-package device, one or more integrated circuits mounted on different substrates, etc.).

Millimeter/centimeter wave transceiver circuitry 28 (sometimes referred to herein simply as transceiver circuitry 28 or millimeter/centimeter wave circuitry 28) may perform spatial ranging operations using radio-frequency signals at millimeter and/or centimeter wave frequencies that are transmitted and received by millimeter/centimeter wave transceiver circuitry 28. The received signals may be a version of the transmitted signals that have been reflected off of external objects and back towards device 10. Control circuitry 14 may process the transmitted and received signals to detect or estimate a range between device 10 and one or more external objects in the surroundings of device 10 (e.g., objects external to device 10 such as the body of a user or other persons, other devices, animals, furniture, walls, or other objects or obstacles in the vicinity of device 10). If desired, control circuitry 14 may also process the transmitted and received signals to identify a two or three-dimensional spatial location of the external objects relative to device 10.

Spatial ranging operations performed by millimeter/centimeter wave transceiver circuitry 28 are unidirectional. If desired, millimeter/centimeter wave transceiver circuitry 28 may also perform bidirectional communications with external wireless equipment such as external wireless equipment 10' (e.g., over bi-directional millimeter/centimeter wave wireless communications link 31). External wireless equipment 10' may include other electronic devices such as electronic device 10, a wireless base station, wireless access point, a wireless accessory, or any other desired equipment that transmits and receives millimeter/centimeter wave signals. Bidirectional communications involve both the transmission of wireless data by millimeter/centimeter wave transceiver circuitry 28 and the reception of wireless data that has been transmitted by external wireless equipment 10'. The wireless data may, for example, include data that has been encoded into corresponding data packets such as wireless data associated with a telephone call, streaming media content, internet browsing, wireless data associated with software applications running on device 10, email messages, etc.

If desired, wireless circuitry 24 may include transceiver circuitry for handling communications at frequencies below 10 GHz such as non-millimeter/centimeter wave transceiver circuitry 26. Non-millimeter/centimeter wave transceiver circuitry 26 may include wireless local area network (WLAN) transceiver circuitry that handles 2.4 GHz and 5 GHz bands for Wi-Fi® (IEEE 802.11) communications, wireless personal area network (WPAN) transceiver circuitry that handles the 2.4 GHz Bluetooth® communications band, cellular telephone transceiver circuitry that handles cellular telephone communications bands from 700 to 960 MHz, 1710 to 2170 MHz, 2300 to 2700 MHz, and/or or any other desired cellular telephone communications bands between 600 MHz and 4000 MHz, GPS receiver circuitry that receives GPS signals at 1575 MHz or signals for handling other satellite positioning data (e.g., GLONASS signals at 1609 MHz), television receiver circuitry, AM/FM radio receiver circuitry, paging system transceiver circuitry, near field communications (NFC) circuitry, etc. Non-millimeter/centimeter wave transceiver circuitry 26 and millimeter/centimeter wave transceiver circuitry 28 may each include one or more integrated circuits, power amplifier circuitry, low-noise input amplifiers, passive radio-frequency components, switching circuitry, transmission line structures, and other circuitry for handling radio-frequency signals.

Wireless circuitry 24 may include antennas 30. Non-millimeter/centimeter wave transceiver circuitry 26 may transmit and receive radio-frequency signals below 10 GHz using one or more antennas 30. Millimeter/centimeter wave transceiver circuitry 28 may transmit and receive radio-frequency signals above 10 GHz (e.g., at millimeter wave and/or centimeter wave frequencies) using antennas 30.

In satellite navigation system links, cellular telephone links, and other long-range links, radio-frequency signals are typically used to convey data over thousands of feet or miles. In Wi-Fi® and Bluetooth® links at 2.4 and 5 GHz and other short-range wireless links, radio-frequency signals are typically used to convey data over tens or hundreds of feet. Millimeter/centimeter wave transceiver circuitry 28 may convey radio-frequency signals over short distances that travel over a line-of-sight path. To enhance signal reception for millimeter and centimeter wave communications, phased antenna arrays and beam forming (steering) techniques may be used (e.g., schemes in which antenna signal phase and/or magnitude for each antenna in an array are adjusted to perform beam steering). Antenna diversity schemes may also be used to ensure that the antennas that have become blocked or that are otherwise degraded due to the operating environment of device 10 can be switched out of use and higher-performing antennas used in their place.

Antennas 30 in wireless circuitry 24 may be formed using any suitable antenna types. For example, antennas 30 may include antennas with resonating elements that are formed from stacked patch antenna structures, loop antenna structures, patch antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. If desired, one or more of antennas 30 may be cavity-backed antennas. Different types of antennas may be used for different bands and combinations of bands. For example, one type of antenna may be used in forming a non-millimeter/centimeter wave wireless link for non-millimeter/centimeter wave transceiver circuitry 26 and another type of antenna may be used in conveying radio-frequency signals at millimeter and/or centimeter wave frequencies for millimeter/centimeter wave transceiver circuitry 28. Antennas 30 that are used to convey radio-frequency signals at millimeter and centimeter wave frequencies may be arranged in one or more phased antenna arrays.

Figure 4:
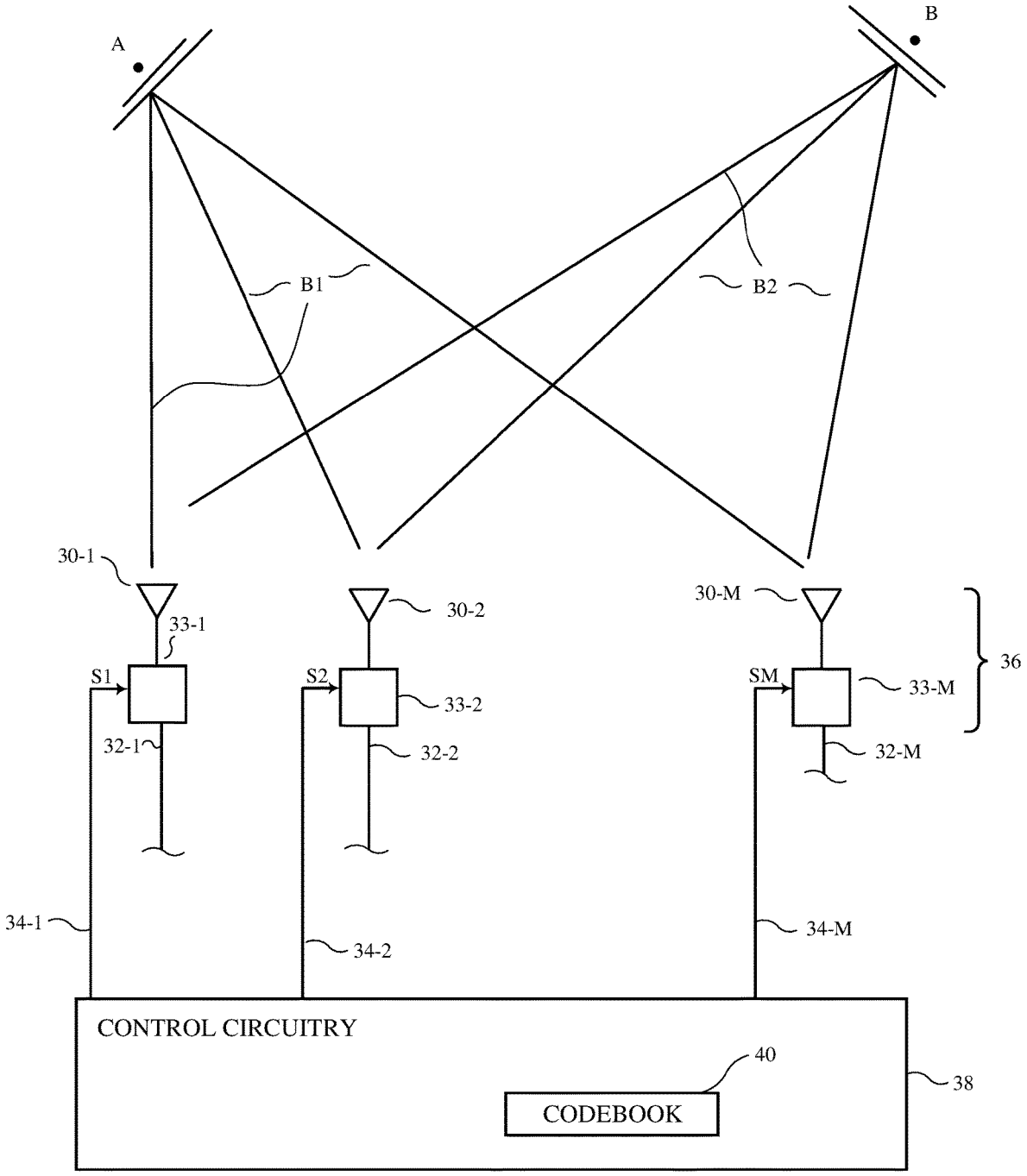
FIG. 4 is a diagram of an illustrative phased antenna array that forms a radio-frequency signal beam at different beam pointing angles in accordance with some embodiments.

FIG. 4 is a diagram showing how antennas 30 for handling radio-frequency signals at millimeter and centimeter wave frequencies may be formed in a phased antenna array. As shown in FIG. 4, phased antenna array 36 (sometimes referred to herein as array 36, antenna array 36, or array 36 of antennas 30) may be coupled to radio-frequency transmission line paths 32. For example, a first antenna 30-1 in phased antenna array 36 may be coupled to a first radio-frequency transmission line path 32-1, a second antenna 30-2 in phased antenna array 36 may be coupled to a second radio-frequency transmission line path 32-2, an Mth antenna 30-M in phased antenna array 36 may be coupled to an Mth radio-frequency transmission line path 32-M, etc. While antennas 30 are described herein as forming a phased antenna array, the antennas 30 in phased antenna array 36 may sometimes also be referred to as collectively forming a single phased array antenna (e.g., where each antenna 30 in the phased array antenna forms an antenna element of the phased array antenna).

Radio-frequency transmission line paths 32 may each be coupled to millimeter/centimeter wave transceiver circuitry 28 of FIG. 3. Each radio-frequency transmission line path 32 may include one or more radio-frequency transmission lines, a positive signal conductor, and a ground signal conductor. The positive signal conductor may be coupled to a positive antenna feed terminal on an antenna resonating element of the corresponding antenna 30. The ground signal conductor may be coupled to a ground antenna feed terminal on an antenna ground for the corresponding antenna 30.

Radio-frequency transmission line paths 32 may include stripline transmission lines (sometimes referred to herein simply as striplines), coaxial cables, coaxial probes realized by metalized vias, microstrip transmission lines, edge-coupled microstrip transmission lines, edge-coupled stripline transmission lines, waveguide structures, conductive vias, combinations of these, etc. Multiple types of transmission lines may be used to couple the millimeter/centimeter wave transceiver circuitry to phased antenna array 36. Filter circuitry, switching circuitry, impedance matching circuitry, phase shifter circuitry, amplifier circuitry, and/or other circuitry may be interposed on radio-frequency transmission line path 32, if desired.

Radio-frequency transmission lines in device 10 may be integrated into ceramic substrates, rigid printed circuit boards, and/or flexible printed circuits. In one suitable arrangement, radio-frequency transmission lines in device 10 may be integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

Antennas 30 in phased antenna array 36 may be arranged in any desired number of rows and columns or in any other desired pattern (e.g., the antennas need not be arranged in a grid pattern having rows and columns). During signal transmission operations, radio-frequency transmission line paths 32 may be used to supply signals (e.g., radio-frequency signals such as millimeter wave and/or centimeter wave signals) from millimeter/centimeter wave transceiver circuitry 28 (FIG. 3) to phased antenna array 36 for wireless transmission. During signal reception operations, radio-frequency transmission line paths 32 may be used to convey signals received at phased antenna array 36 (e.g., from external wireless equipment 10' of FIG. 3) to millimeter/centimeter wave transceiver circuitry 28 (FIG. 3).

The use of multiple antennas 30 in phased antenna array 36 allows radio-frequency beam forming arrangements (sometimes referred to herein as radio-frequency beam steering arrangements) to be implemented by controlling the relative phases and magnitudes (amplitudes) of the radio-frequency signals conveyed by the antennas. In the example of FIG. 4, the antennas 30 in phased antenna array 36 each have a corresponding radio-frequency phase and magnitude controller 33 (e.g., a first phase and magnitude controller 33-1 interposed on radio-frequency transmission line path 32-1 may control phase and magnitude for radio-frequency signals handled by antenna 30-1, a second phase and magnitude controller 33-2 interposed on radio-frequency transmission line path 32-2 may control phase and magnitude for radio-frequency signals handled by antenna 30-2, an Mth phase and magnitude controller 33-M interposed on radio-frequency transmission line path 32-M may control phase and magnitude for radio-frequency signals handled by antenna 30-M, etc.).

Phase and magnitude controllers 33 may each include circuitry for adjusting the phase of the radio-frequency signals on radio-frequency transmission line paths 32 (e.g., phase shifter circuits) and/or circuitry for adjusting the magnitude of the radio-frequency signals on radio-frequency transmission line paths 32 (e.g., power amplifier and/or low noise amplifier circuits). Phase and magnitude controllers 33 may sometimes be referred to collectively herein as beam steering or beam forming circuitry (e.g., beam steering circuitry that steers the beam of radio-frequency signals transmitted and/or received by phased antenna array 36).

Phase and magnitude controllers 33 may adjust the relative phases and/or magnitudes of the transmitted signals that are provided to each of the antennas in phased antenna array 36 and may adjust the relative phases and/or magnitudes of the received signals that are received by phased antenna array 36. Phase and magnitude controllers 33 may, if desired, include phase detection circuitry for detecting the phases of the received signals that are received by phased antenna array 36. The term "beam," "signal beam," "radio-frequency beam," or "radio-frequency signal beam" may be used herein to collectively refer to wireless signals that are transmitted and received by phased antenna array 36 in a particular direction. The signal beam may exhibit a peak gain that is oriented in a particular beam pointing direction at a corresponding beam pointing angle (e.g., based on constructive and destructive interference from the combination of signals from each antenna in the phased antenna array). The term "transmit beam" may sometimes be used herein to refer to radio-frequency signals that are transmitted in a particular direction whereas the term "receive beam" may sometimes be used herein to refer to radio-frequency signals that are received from a particular direction.

If, for example, phase and magnitude controllers 33 are adjusted to produce a first set of phases and/or magnitudes for transmitted radio-frequency signals, the transmitted signals will form a transmit beam as shown by beam B1 of FIG. 4 that is oriented in the direction of point A. If, however, phase and magnitude controllers 33 are adjusted to produce a second set of phases and/or magnitudes for the transmitted signals, the transmitted signals will form a transmit beam as shown by beam B2 that is oriented in the direction of point B. Similarly, if phase and magnitude controllers 33 are adjusted to produce the first set of phases and/or magnitudes, radio-frequency signals (e.g., radio-frequency signals in a receive beam) may be received from the direction of point A, as shown by beam B1. If phase and magnitude controllers 33 are adjusted to produce the second set of phases and/or magnitudes, radio-frequency signals may be received from the direction of point B, as shown by beam B2.

Each phase and magnitude controller 33 may be controlled to produce a desired phase and/or magnitude based on a corresponding control signal S received from control circuitry 38 of FIG. 4 over control paths 34 (e.g., the phase and/or magnitude provided by phase and magnitude controller 33-1 may be controlled using control signal 51 on control path 34-1, the phase and/or magnitude provided by phase and magnitude controller 33-2 may be controlled using control signal S2 on control path 34-2, the phase and/or magnitude provided by phase and magnitude controller 33-M may be controlled using control signal SM on control path 34-M, etc.). If desired, control circuitry 38 may actively adjust control signals S in real time to steer the transmit or receive beam in different desired directions (e.g., to different desired beam pointing angles) over time. Phase and magnitude controllers 33 may provide information identifying the phase of received signals to control circuitry 38 if desired.

When performing wireless communications using radio-frequency signals at millimeter and centimeter wave frequencies, the radio-frequency signals are conveyed over a line of sight path between phased antenna array 36 and external wireless equipment (e.g., external wireless equipment 10' of FIG. 3). If the external wireless equipment is located at point A of FIG. 4, phase and magnitude controllers 33 may be adjusted to steer the signal beam towards point A (e.g., to form a signal beam having a beam pointing angle directed towards point A). Phased antenna array 36 may then transmit and receive radio-frequency signals in the direction of point A. Similarly, if the external wireless equipment is located at point B, phase and magnitude controllers 33 may be adjusted to steer the signal beam towards point B (e.g., to form a signal beam having a beam pointing angle directed towards point B). Phased antenna array 36 may then transmit and receive radio-frequency signals in the direction of point B. In the example of FIG. 4, beam steering is shown as being performed over a single degree of freedom for the sake of simplicity (e.g., towards the left and right on the page of FIG. 4). However, in practice, the beam may be steered over two or more degrees of freedom (e.g., in three dimensions, into and out of the page and to the left and right on the page of FIG. 4). Phased antenna array 36 may have a corresponding field of view over which beam steering can be performed (e.g., in a hemisphere or a segment of a hemisphere over the phased antenna array). If desired, device 10 may include multiple phased antenna arrays that each face a different direction to provide coverage from multiple sides of the device.

Control circuitry 38 of FIG. 4 may form a part of control circuitry 14 of FIG. 3 or may be separate from control circuitry 14 of FIG. 3. Control circuitry 38 of FIG. 4 may identify a desired beam pointing angle for the signal beam of phased antenna array 36 and may adjust the control signals S provided to phased antenna array 36 to configure phased antenna array 36 to form (steer) the signal beam at that beam pointing angle. Each possible beam pointing angle that can be used by phased antenna array 36 during wireless communications may be identified by a beam steering codebook such as codebook 40. Codebook 40 may be stored at control circuitry 38, elsewhere on device 10, or may be located (offloaded) on external equipment and conveyed to device 10 over a wired or wireless communications link.

Codebook 40 may identify each possible beam pointing angle that may be used by phased antenna array 36. Control circuitry 38 may store or identify phase and magnitude settings for phase and magnitude controllers 33 to use in implementing each of those beam pointing angles (e.g., control circuitry 38 or codebook 40 may include information that maps each beam pointing angle for phased antenna array 36 to a corresponding set of phase and magnitude values for phase and magnitude controllers 33). Codebook 40 may be hard-coded or soft-coded into control circuitry 38 or elsewhere in device 10, may include one or more databases stored at control circuitry 38 or elsewhere in device 10 (e.g., codebook 40 may be stored as software code), may include one or more look-up-tables at control circuitry 38 or elsewhere in device 10, and/or may include any other desired data structures stored in hardware and/or software on device 10. Codebook 40 may be generated during calibration of device 10 (e.g., during design, manufacturing, and/or testing of device 10 prior to device 10 being received by an end user) and/or may be dynamically updated over time (e.g., after device 10 has been used by an end user).

Control circuitry 38 may generate control signals S based on codebook 40. For example, control circuitry 38 may identify a beam pointing angle that would be needed to communicate with external wireless equipment 10' of FIG. 3 (e.g., a beam pointing angle pointing towards external wireless equipment 10'). Control circuitry 38 may subsequently identify the beam pointing angle in codebook 40 that is closest to this identified beam pointing angle. Control circuitry 38 may use codebook 40 to generate phase and magnitude values for phase and magnitude controllers 33. Control circuitry 38 may transmit control signals S identifying these phase and magnitude values to phase and magnitude controllers 33 over control paths 34. The beam formed by phased antenna array 36 using control signals S will be oriented at the beam pointing angle identified by codebook 40. If desired, control circuitry 38 may sweep over some or all of the different beam pointing angles identified by codebook 40 until the external wireless equipment is found and may use the corresponding beam pointing angle at which the external wireless equipment was found to communicate with the external wireless equipment (e.g., over communications link 31 of FIG. 3).

Figure 5:
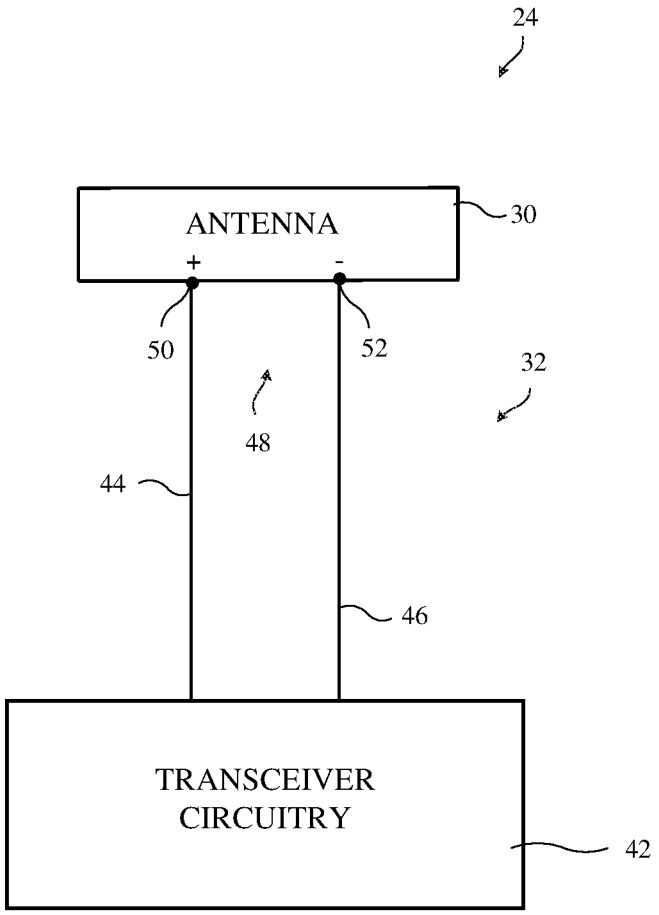
FIG. 5 is a diagram of an illustrative transceiver circuit and antenna in accordance with some embodiments.

A schematic diagram of an antenna 30 that may be formed in phased antenna array 36 (e.g., as antenna 30-1, 30-2, 30-3, and/or 30-N in phased antenna array 36 of FIG. 4) is shown in FIG. 5. As shown in FIG. 5, antenna 30 may be coupled to transceiver circuitry 42 (e.g., millimeter wave transceiver circuitry 28 of FIG. 3). Transceiver circuitry 42 may be coupled to antenna feed 48 of antenna 30 using radio-frequency transmission line path 32. Antenna feed 48 may include a positive antenna feed terminal such as positive antenna feed terminal 50 and may include a ground antenna feed terminal such as ground antenna feed terminal 52. Radio-frequency transmission line path 32 may include a positive signal conductor such as signal conductor 44 that is coupled to positive antenna feed terminal 50 and a ground conductor such as ground conductor 46 that is coupled to ground antenna feed terminal 52.

Any desired antenna structures may be used for implementing antenna 30. In one suitable arrangement that is sometimes described herein as an example, patch antenna structures may be used for implementing antenna 30. Antennas 30 that are implemented using patch antenna structures may sometimes be referred to herein as patch antennas. An illustrative patch antenna that may be used in phased antenna array 36 of FIG. 4 is shown in FIG. 6.

Figure 6:
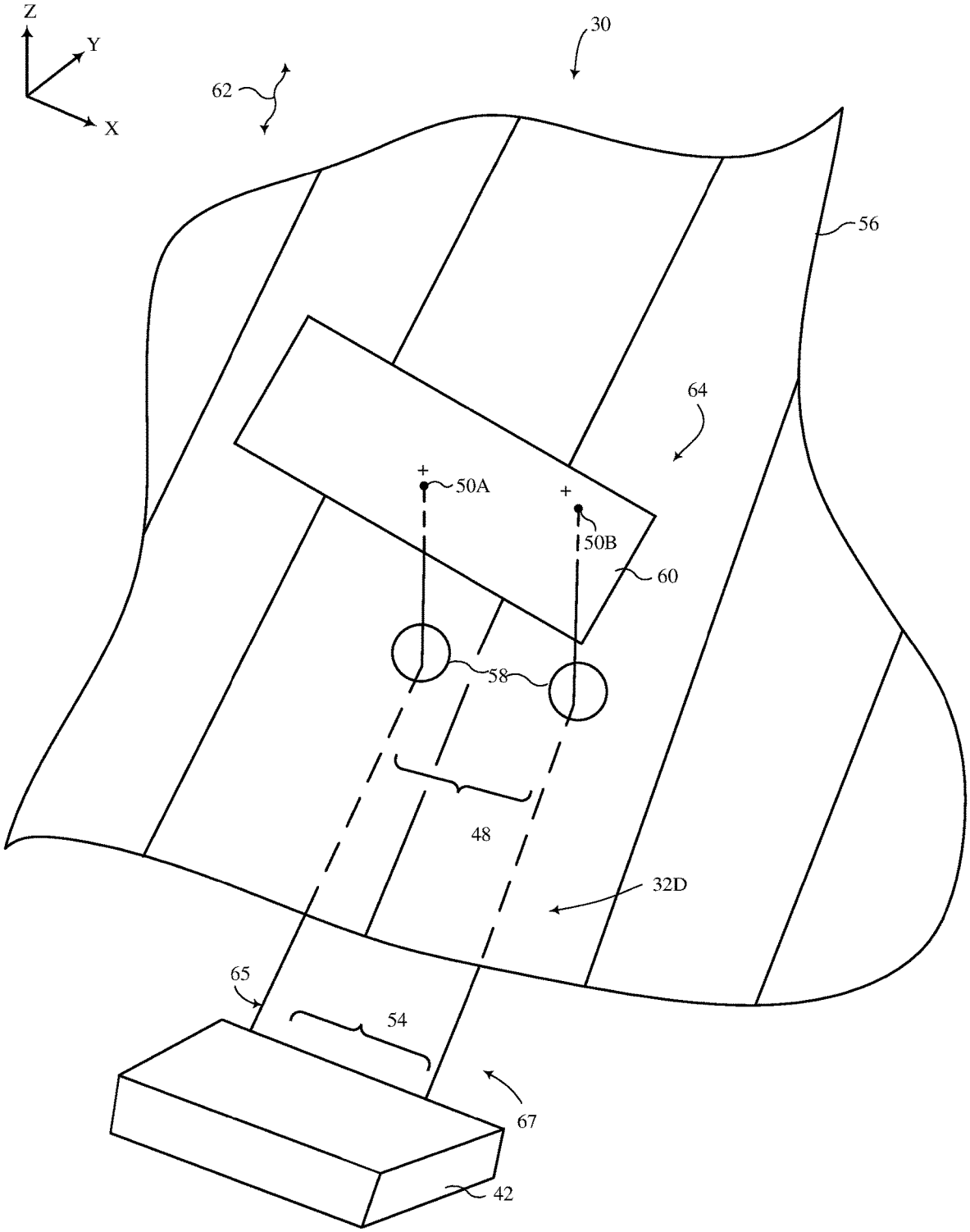
FIG. 6 is a perspective view of an illustrative differentially-fed patch antenna in accordance with some embodiments.

As shown in FIG. 6, antenna 30 may have an antenna radiating element 64 (sometimes referred to herein as antenna resonating element 64, patch antenna resonating element 64, or patch antenna radiating element 64). Antenna radiating element 64 may include a patch element 60. Patch element 60 (sometimes referred to herein as patch 60 or conductive patch 60) may be formed from conductive traces on an underlying substrate (not shown in FIG. 6 for the sake of clarity) or from any other desired conductive materials.

Patch element 60 may be separated from and extend parallel to an antenna ground such as antenna ground 56 (sometimes referred to herein as antenna ground plane 56). Patch element 60 may lie within a plane such as the X-Y plane of FIG. 6 (e.g., the lateral surface area of patch element 60 may lie in the X-Y plane). Antenna ground 56 may lie within a plane that is parallel to the plane of patch element 60. Patch element 60 and antenna ground 56 may therefore lie in separate parallel planes that are separated by a fixed distance. Antenna ground 56 may be formed from conductive traces patterned on a dielectric substrate (e.g., the dielectric substrate used to support patch element 60) and/or any other desired conductive structures (e.g., conductive portions of the housing for device 10, conductive portions of components in device 10, etc.).

The length of the sides of patch element 60 may be selected so that antenna 30 resonates (radiates) at desired operating frequencies. In the arrangement of FIG. 6, for example, the length of the side (edge) of patch element 60 extending parallel to the X-axis may be selected to be approximately equal to half of the wavelength of the signals conveyed by antenna 30 (e.g., the effective wavelength given the dielectric properties of the materials surrounding patch element 60). In one suitable arrangement, this length may be between 0.8 mm and 1.2 mm (e.g., approximately 1.1 mm) for covering a millimeter wave frequency band between 57 GHz and 70 GHz, as just one example.

The example of FIG. 6 is merely illustrative. Patch element 60 may have a square shape in which all of the sides of patch element 60 are the same length or may have a different rectangular shape. Patch element 60 may be formed in other shapes having any desired number of straight and/or curved edges. If desired, patch element 60 and antenna ground 56 may have different shapes and relative orientations.

In the example of FIG. 6, patch element 60 is differentially fed using a differential radio-frequency transmission line path such as differential radio-frequency transmission line path 32D. For example, antenna feed 48 may be a differential feed having two positive antenna feed terminals (e.g., positive antenna feed terminals 50 of FIG. 5) such as a first positive antenna feed terminal 50A and a second positive antenna feed terminal 50B coupled to different locations on patch element 60.

As shown in FIG. 6, transceiver circuitry 42 may include a differential signal port 54 coupled to differential radio-frequency transmission line path 32D (e.g., a radio-frequency transmission line path such as radio-frequency transmission line path 32 of FIG. 5 that has been configured to convey differential signals). Differential radio-frequency transmission line path 32D may have a first signal trace 65 and a second signal trace 67 (e.g., differential signal traces). Differential radio-frequency transmission line path 32D may include a first conductive via that couples first signal trace 65 to positive antenna feed terminal 50A. Differential radio-frequency transmission line path 32D may include a second conductive via that couples second signal trace 67 to positive antenna feed terminal 50B. The first and second conductive vias may extend through respective holes or openings 58 in antenna ground 56. The first and second conductive vias and signal traces 65 and 67 may collectively form the signal conductor for differential radio-frequency transmission line path 32D (e.g., signal conductor 44 of FIG. 5). Differential signal port 54 may, for example, be a 100 Ohm port whereas signal traces 65 and 67 are each 50 Ohm paths.

The radio-frequency signals conveyed by positive antenna feed terminal 50A and radio-signal trace 65 may be out of phase (e.g., approximately 180 degrees out of phase) with the radio-frequency signals conveyed by positive antenna feed terminal 50B and signal trace 67. Transceiver circuitry 42 may, for example, include phase shifter circuitry that transmits, via differential signal port 54, radio-frequency signals on signal trace 65 that are out of phase with the radio-frequency signals on signal trace 67. Differentially feeding antenna 30 in this way may, for example, minimize cross polarization interference in phased antenna array 36 (FIG. 4) and optimize the uniformity of the radiation pattern for antenna 30.

In the example of FIG. 6, antenna 30 is differentially-fed and conveys radio-frequency signals 62 using a single linear polarization (e.g., where the electric field of radio-frequency signals 62 are aligned along a single axis). This example is merely illustrative. If desired, antenna 30 may be fed using single-ended signals (e.g., antenna feed 48 may include only a single positive antenna feed terminal 50A that conveys single-ended radio-frequency signals). In scenarios where antenna 30 is fed using single-ended signals, antenna 30 may include multiple antenna feeds each coupled to patch element 60 and a respective port on transceiver circuitry 42 for covering other polarizations (e.g., both horizontal and vertical linear polarizations, a circular polarization, an elliptical polarization, etc.). If desired, antenna 30 may include one or more parasitic antenna resonating element formed from conductive traces that are stacked over (e.g., overlapping and/or aligned with) patch element 60 and/or that are coplanar with patch element 60. The shape of the parasitic elements and/or the shape of patch element 60 may be selected to help match the impedance of antenna 30 to the impedance of the radio-frequency transmission line path(s) coupled to antenna 30. The antenna structures shown in FIG. 6 are merely illustrative and, in general, any desired types of antennas may be used in phased antenna array 36 of FIG. 4. If desired, phased antenna array 36 may be integrated with other circuitry such as a radio-frequency integrated circuit to form an integrated antenna module.

Figure 7:
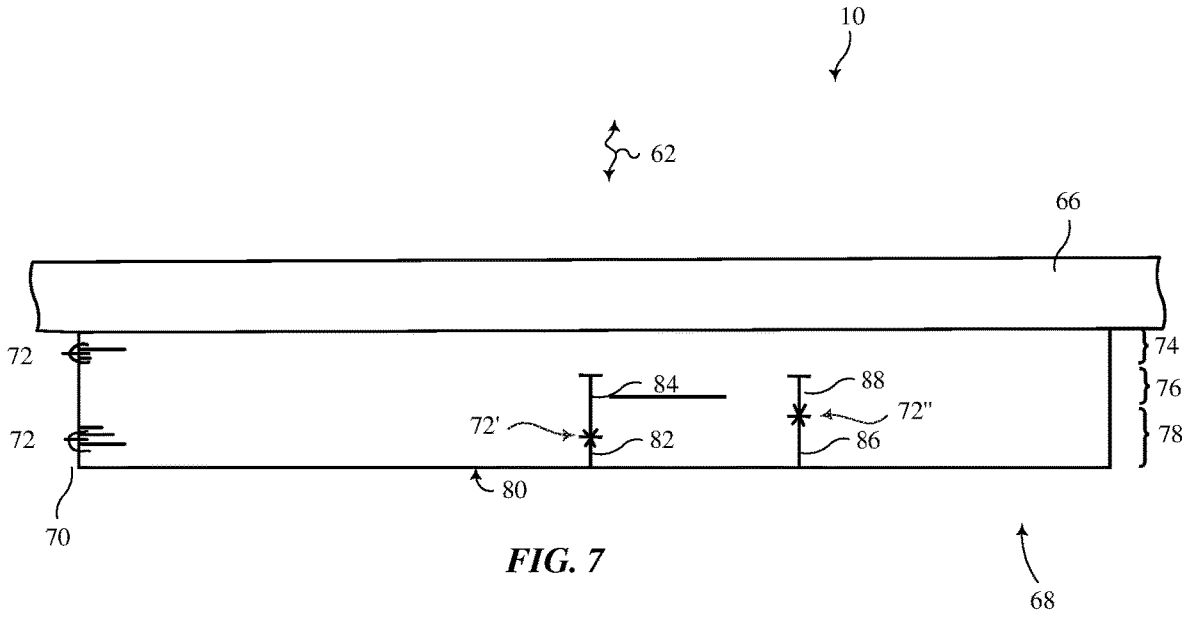
FIG. 7 is a cross-sectional side view of an illustrative antenna module mounted to a dielectric cover layer in an electronic device in accordance with some embodiments.

FIG. 7 is a cross-sectional side view of an illustrative antenna module for handling signals at frequencies greater than 10 GHz in device 10. As shown in FIG. 7, device 10 may be provided with an antenna module such as antenna module 68. If desired, transceiver circuitry (e.g., transceiver 42 of FIGS. 5 and 6) may be mounted to antenna module 68. Antenna module 68 may include phased antenna array 36 of antennas 30 (FIG. 4) formed on a dielectric substrate such as dielectric substrate 70. Substrate 70 may be, for example, a rigid or printed circuit board or other dielectric substrate. Substrate 70 may be a stacked dielectric substrate that includes multiple stacked dielectric layers 72 (e.g., multiple layers of printed circuit board substrate such as multiple layers of fiberglass-filled epoxy, rigid printed circuit board material, flexible printed circuit board material, ceramic, plastic, glass, or other dielectrics). The phased antenna array may include any desired number of antennas arranged in any desired pattern on substrate 70.

The antennas in the phased antenna array 36 may include elements such as patch element 60 (FIG. 6), ground traces (e.g., conductive traces forming antenna ground 56 of FIG. 6 for each of the antennas 30 in the phased antenna array), and/or other components such as parasitic elements that are interposed between or formed on dielectric layers 72 of substrate 70. Substrate 70 may include a set 78 of dielectric layers 72 that are used to form radio-frequency transmission line paths (e.g., the differential radio-frequency transmission line path 32D of FIG. 6) for each of the antennas. The set 78 of dielectric layers 72 may therefore sometimes be referred to herein as transmission line layers 78. Conductive traces used in forming the signal conductors (e.g., signal conductor 44 of FIG. 5 and signal traces 65 and 67 of FIG. 6) and/or the ground conductors (e.g., ground conductor 46 of FIG. 5) may be formed on transmission line layers 78.

Substrate 70 may also include a set 76 of dielectric layers 72 stacked over transmission line layers 78. Conductive traces used in forming the antenna radiating element (e.g., patch element 60 in antenna radiating element 64 of FIG. 6) for the antennas in the phased antenna array may be formed on the set 76 of dielectric layers 72. The set 76 of dielectric layers 72 may therefore sometimes be referred to herein as antenna layers 76.

If desired, substrate 70 may also include a set 74 of dielectric layers 72 stacked over antenna layers 76. The set 74 of dielectric layers 72 may be free of conductive material and may therefore sometimes be referred to herein as cavity layers 74. Cavity layers 74 may be omitted if desired. Cavity layers 74, antenna layers 76, and transmission line layers 78 may each include any desired number of dielectric layers 72 (e.g., one dielectric layer 72, two dielectric layers 72, four dielectric layers 72, more than two dielectric layers 72, twelve dielectric layers 72, sixteen dielectric layers 72, etc.).

Antenna module 68 may be mounted overlapping a dielectric cover layer for device 10 such as dielectric cover layer 66. Dielectric cover layer 66 may form a housing wall for device 10 (e.g., sidewalls 12E or rear housing wall 12R of FIG. 2), an antenna window in a housing wall for device 10, a display cover layer for display 8 of FIG. 1, etc. Dielectric cover layer 66 may be formed from glass, ceramic, plastic, sapphire, or any other desired dielectric material. Antenna module 68 may be separated from dielectric cover layer 66 by a gap, may be placed in contact with dielectric cover layer 66, may be pressed or biased against dielectric cover layer 66, or may be adhered to dielectric cover layer 66 using adhesive. Cavity layers 74 may be used to help set a desired distance between the antenna radiating elements in antenna module 68 and dielectric cover layer 66 if desired (e.g., to minimize signal reflections at the interfaces of dielectric cover layer 66). The phased antenna array on antenna module 68 may convey radio-frequency signals 62 through dielectric cover layer 66.

The phased antenna array on antenna module 68 (e.g., phased antenna array 36 of FIG. 4) may include any desired number of antennas 30 (e.g., two antennas, three antennas, four antennas, twelve antennas, more than four antennas, sixteen antennas, twenty antennas, etc.). If desired, the phased antenna array may include different sets of antennas, where each set of antenna covers a respective frequency band and/or polarization. For example, the phased antenna array may include a first set of antennas that convey radio-frequency signals in a first frequency band that includes 40 GHz, a second set of antennas that convey radio-frequency signals in a second frequency band that includes 39 GHz, and a third set of antennas that convey radio-frequency signals in a third frequency band that includes 60 GHz. This example is merely illustrative and, in general, the phased antenna array may cover any desired number of frequency bands at any desired frequencies.

Each antenna in the phased antenna array is fed using at least one respective radio-frequency transmission line path (e.g., radio-frequency transmission line path 32 of FIG. 5). In general, the greater the number of antennas in the phased antenna array, the greater the peak gain for the phased antenna array. As the number of frequency bands and polarizations covered by the phased antenna array increase, the number of radio-frequency transmission line paths formed in transmission line layers 78 of antenna module 68 increases. Differentially feeding the antennas (e.g., using positive antenna feed terminals 50A and 50B and signal traces 65 and 67 of FIG. 6) further increases the number of radio-frequency transmission line paths formed in transmission line layers 78. If care is not taken, it can be difficult to accommodate all of the required radio-frequency transmission line paths required for the phased antenna array in transmission line layers 78, while still ensuring that there is satisfactory electromagnetic isolation between each of the radio-frequency transmission line paths.

In order to help increase electromagnetic isolation between each of the radio-frequency transmission line paths for the phased antenna array, the radio-frequency transmission line paths may be formed on different dielectric layers 72 of transmission line layers 78. For example, some of the antennas in the phased antenna array may be fed using radio-frequency transmission line paths having signal traces patterned on a given dielectric layer 72' located at distance 82 from bottom edge 80 of substrate 70. At the same time, other antennas in the phased antenna array may be fed using radio-frequency transmission line paths having signal traces patterned on a different dielectric layer 72" located at distance 86 from bottom edge 80 of substrate 70. Distance 82 may, for example, be less than distance 86 (e.g., dielectric layer 72" is closer to antenna layers 76 than dielectric layer 72'). This is merely illustrative and, if desired, the signal traces for the radio-frequency transmission line paths may be patterned on more than two dielectric layers 72 in transmission line layers 78.

As shown in FIG. 7, the signal traces patterned on dielectric layer 72' may be located at a relatively long distance 84 from antenna layers 76. The signal traces patterned on dielectric layer 72" may be located at a relatively short distance 88 from antenna layers 76. Conductive vias may be used to couple the signal traces on dielectric layers 72' and 72" to corresponding antenna radiating elements on antenna layers 76. Because distance 84 is longer than distance 88, if care is not taken, the conductive vias used to couple the signal traces on dielectric layer 72' to antenna layers 76 may introduce a greater amount of inductance to the radio-frequency transmission line paths than the conductive vias used to couple the signal traces on dielectric layer 72" to antenna layers 76. This non-uniform inductance may introduce undesirable impedance mismatches across the phased antenna array, thereby limiting the overall antenna efficiency for the phased antenna array.

In some scenarios, capacitors may be interposed on a radio-frequency transmission line to help compensate for excessive inductances on the radio-frequency transmission line. However, discrete capacitors such as capacitors formed from surface-mount technology (SMT) components may be unsuitable for relatively compact and relatively high-frequency structures such as antenna module 68. In order to mitigate these excessive inductances without using discrete capacitors, the antenna radiating elements in then phased antenna array may be formed from stacked layers of conductive traces that are coupled together using conductive vias.

Figure 8:
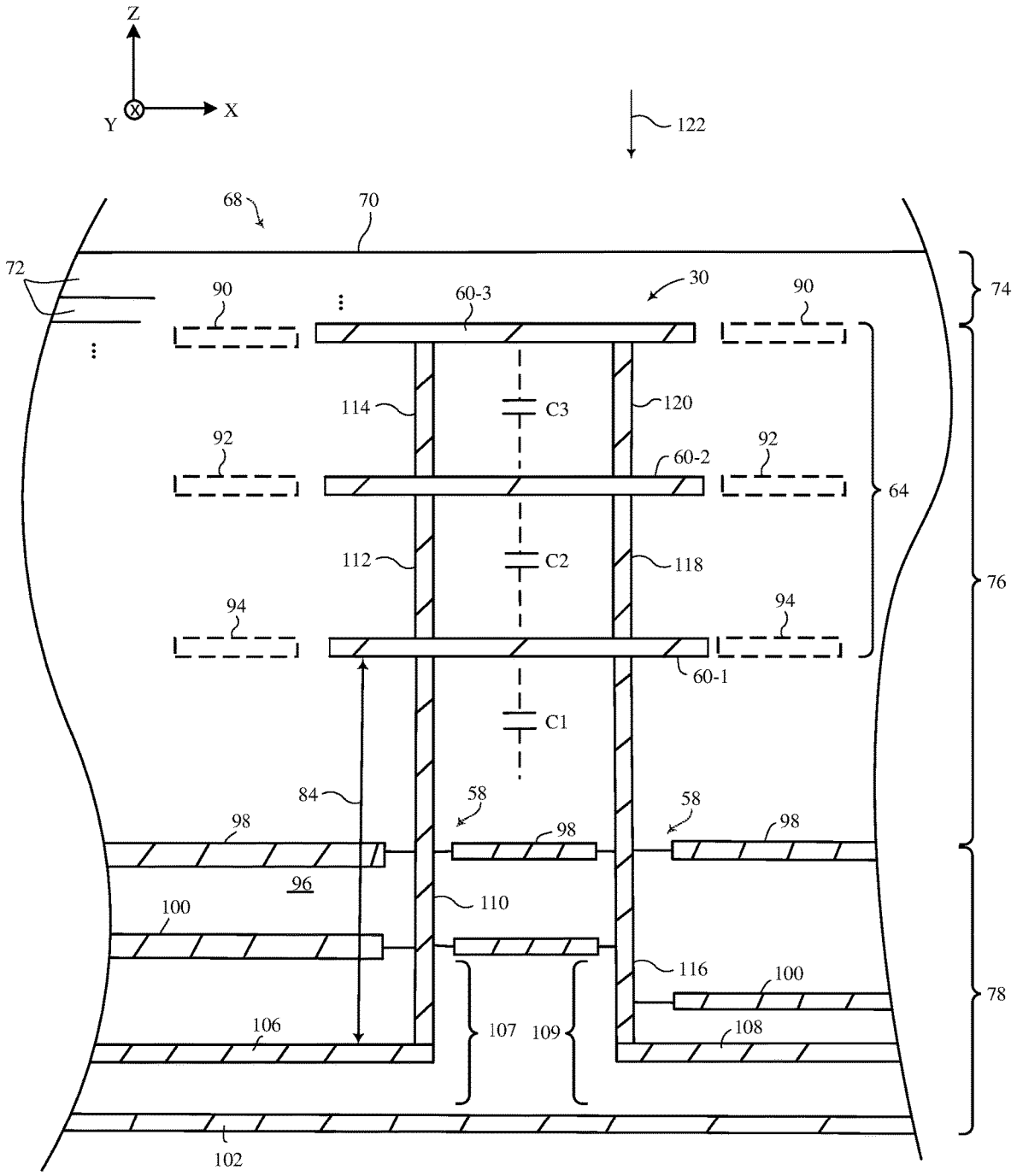
FIG. 8 is a cross-sectional side view of an illustrative antenna having a radiating element formed from stacked layers of conductive traces that are coupled together using conductive vias in accordance with some embodiments.

FIG. 8 is a cross-sectional side view of a given antenna 30 in the phased antenna array (e.g., phased antenna array 36 of FIG. 4) having an antenna radiating element formed from stacked layers of conductive traces that are coupled together using conductive vias. As shown in FIG. 8, antenna radiating element 64 of antenna 30 is embedded within antenna layers 76 of dielectric substrate 70.

Antenna radiating element 64 may include stacked layers of conductive traces formed on different dielectric layers 72 of antenna layers 76. For example, antenna radiating element 64 may include a first patch element 60-1 formed from conductive traces on a first dielectric layer 72, a second patch element 60-2 formed from conductive traces on a second dielectric layer stacked over the first dielectric layer, and a third patch element 60-3 formed from conductive traces on a third dielectric layer stacked over the second dielectric layer (e.g., patch element 60-2 may be vertically-interposed between patch elements 60-1 and 60-3). One or more than one dielectric layer 72 may separate patch element 60-1 from patch element 60-2. One or more than one dielectric layer 72 may separate patch element 60-2 from patch element 60-3. One or more than one dielectric layer 72 may separate patch element 60-1 from ground traces 98.

Ground traces 98 may separate antenna layers 76 from transmission line layers 78 in substrate 70. Transmission line layers 78 may also include ground traces 100 and ground traces 102. Ground traces 98, ground traces 100, ground traces 102, and/or any other ground traces in transmission line layers 78 may form part of antenna ground 56 of FIG. 6.

In the example of FIG. 8, antenna 30 is differentially-fed using first and second radio-frequency transmission lines such as striplines 107 and 109 (e.g., striplines that form part of a differential radio-frequency transmission line path such as differential radio-frequency transmission line path 32D of FIG. 6). Other types of radio-frequency transmission lines may be used to feed antenna 30 if desired. Stripline 107 may include signal trace 106 (e.g., signal trace 65 of FIG. 6) and the portion of ground traces 100 and 102 overlapping signal trace 106. Signal trace 106 may be coupled to conductive via 110. If desired, there may also be ground traces laterally surrounding signal trace 106 (e.g., in the X-Y plane). Conductive via 110 may extend through transmission line layers 78, a hole 58 in ground traces 98, and some of antenna layers 76 to couple signal trace 106 to patch element 60-1 (e.g., to form a first positive antenna feed terminal for the antenna such as positive antenna feed terminal 50A of FIG. 6).

Stripline 109 may include signal trace 108 (e.g., signal trace 67 of FIG. 6) and the portion of ground traces 100 and 102 overlapping signal trace 108. Signal trace 108 may be coupled to conductive via 116. If desired, there may also be ground traces laterally surrounding signal trace 108 (e.g., in the X-Y plane). Conductive via 116 may extend through transmission line layers 78, a hole 58 in ground traces 98, and some of antenna layers 76 to couple signal trace 108 to patch element 60-1 (e.g., to form a second positive antenna feed terminal for the antenna such as positive antenna feed terminal 50B of FIG. 6). Conductive vias 110 and 116 and signal traces 106 and 108 may collectively form the signal conductor (e.g., signal conductor 44 of FIG. 5) for the differential radio-frequency transmission line coupled to antenna 30. Ground traces 100 and 102 and/or other ground traces in transmission line layers 78 may collectively form the ground conductor (e.g., ground conductor 46 of FIG. 5) for the differential radio-frequency transmission line coupled to antenna 30.

Transmission line layers 78 may include additional routing layers 96 between ground traces 100 and 98. Additional routing layers 96 may be used to form the radio-frequency transmission line paths for other antennas in antenna module 68 (e.g., signal traces 106 and 108 may be located at distance 82 whereas routing layers 96 are located at distance 86 or other distances greater than distance 82 from bottom edge 80 of antenna module 68 as shown in FIG. 7). Conductive vias 110 and 116 of FIG. 8 may extend through routing layers 96 to antenna radiating element 64, such that the conductive vias extend across distance 84 from signal traces 106 and 108 to patch element 60-1. Because distance 84 is relatively long, this may cause conductive vias 110 and 116 to exhibit relatively high inductances.

As shown in FIG. 8, conductive via 112 may be laterally aligned with conductive via 110 and may couple patch element 60-1 to patch element 60-2 (e.g., conductive via 112 may electrically (galvanically) connect patch element 60-1 to patch element 60-2). Conductive via 114 may be laterally aligned with conductive vias 112 and 110 and may couple patch element 60-2 to patch element 60-3 (e.g., conductive via 112 may electrically (galvanically) connect patch element 60-2 to patch element 60-3). Conductive vias 110 and 112 may, for example, be soldered to opposing sides of patch element 60-1. Conductive vias 112 and 114 may, for example, be soldered to opposing sides of patch element 60-2.

Similarly, conductive via 118 may be laterally aligned with conductive via 116 and may couple patch element 60-1 to patch element 60-2 (e.g., conductive via 118 may electrically (galvanically) connect patch element 60-1 to patch element 60-2). Conductive via 120 may be laterally aligned with conductive vias 118 and 116 and may couple patch element 60-2 to patch element 60-3 (e.g., conductive via 120 may electrically (galvanically) connect patch element 60-2 to patch element 60-3). Conductive vias 116 and 118 may, for example, be soldered to opposing sides of patch element 60-1. Conductive vias 118 and 120 may, for example, be soldered to opposing sides of patch element 60-2. Conductive vias 110, 112, and 114 may sometimes be described herein as forming different portions of the same conductive via extending from signal trace 106 to patch element 60-3. Similarly, conductive vias 116, 118, and 120 may sometimes be described herein as forming different portions of the same conductive via extending from signal trace 108 to patch element 60-3.

By forming antenna radiating element 64 from vertically-stacked patch elements 60-1, 60-2, and 60-3 in this way, additional capacitances may be introduced to antenna 30 that help to compensate for the relatively high inductances of conductive vias 110 and 116. For example, patch element 60-1 and ground traces 98 may exhibit a first capacitance C1, patch element 60-2 and patch element 60-1 may exhibit a second capacitance C2, and patch element 60-2 and patch element 60-3 may exhibit a third capacitance C3. Vertically interposing capacitances C1, C2, and C3 on antenna radiating element 64 in this way may help to offset the relatively high inductances of conductive vias 110 and 116, thereby helping to match the impedance of antenna 30 to the impedance of striplines 107 and 109, despite signal traces 106 and 108 being located at the relatively long distance 84 from antenna radiating element 64. This may allow for a relatively large number of radio-frequency transmission line paths to be integrated into antenna module 68 with satisfactory isolation without introducing undesirable impedance mismatches in the antenna module, thereby optimizing antenna efficiency for the phased antenna array.

The example of FIG. 8 is merely illustrative. In the example of FIG. 8, patch elements 60-1, 60-2, and 60-3 are all the same size and shape and are all completely overlapping. If desired, two or more of patch elements 60-1, 60-2, and 60-3 may be different sizes and/or different shapes (e.g., for tweaking the frequency response, bandwidth, and/or impedance matching for the antenna). Two or more of patch elements 60-1, 60-2, and 60-3 may be partially non-overlapping if desired. Antenna radiating element 64 may include only two patch elements (e.g., patch element 60-3 and conductive vias 114 and 120 may be omitted) or may include more than three patch elements (e.g., additional patch elements may be stacked over patch element 60-3 and coupled to patch element 60-3 using conductive vias). Antenna 30 need not be differentially fed and may, if desired, be fed using single-ended signals (e.g., using a single radio-frequency transmission line path coupled to antenna radiating element 64).

If desired, antenna radiating element 64 may include one or more parasitic elements that are not directly fed by conductive vias 110 and 116. For example, antenna radiating element 64 may include parasitic elements 90 formed from conductive traces coplanar with patch element 60-3, parasitic elements 92 formed from conductive traces coplanar with patch element 60-2, and/or parasitic elements 94 formed from conductive traces coplanar with patch element 60-1. Parasitic elements 90, 92, and 94 may sometimes be referred to herein as parasitic antenna resonating elements, parasitic antenna radiating elements, or parasitics. One or more parasitic elements may be stacked over (e.g., overlapping) patch element 60-3 if desired.

Figure 9:
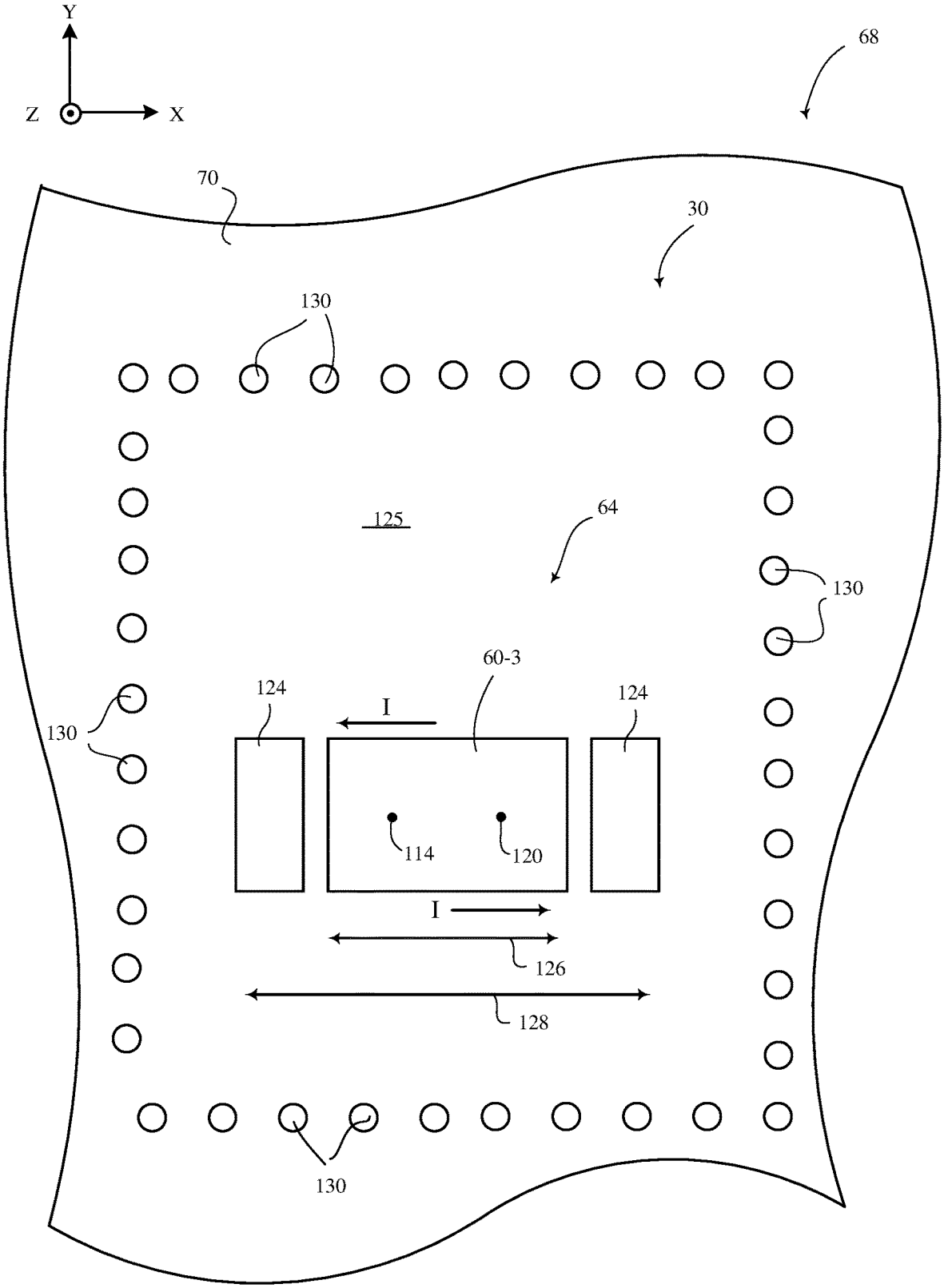
FIG. 9 is a top-down view of an illustrative antenna of the type shown in FIG. 8 having parasitic elements for adjusting the frequency response of the antenna in accordance with some embodiments.

FIG. 9 is a top-down view of the differentially-fed antenna 30 of FIG. 8 (e.g., as taken in the direction of arrow 122 of FIG. 8). In the example of FIG. 9, cavity layers 74 of substrate 70 have been omitted for the sake of clarity. As shown in FIG. 9, antenna radiating element 64 may include parasitic elements such as parasitic elements 124. Parasitic elements 124 may include parasitic elements 90, 92, and/or 94 of FIG. 8. Conductive via 114 may contact patch element 60-3 at a first location whereas conductive via 120 contacts patch element 60-3 at a second location. Differential radio-frequency signals may be provided to patch element 60-3 over conductive vias 114 and 120. Corresponding antenna currents I may flow around the perimeter of patch element 60-3. Similar antenna currents may also flow around the edges of the underlying patch elements 60-2 and 60-1 (FIG. 8).

In the absence of parasitic elements 124, length 126 of patch element 60-3 determines the response frequencies of antenna 30 (e.g., length 126 may be approximately half of the effective wavelength of operation for antenna 30). In the presence of parasitic elements 124, antenna currents I may also flow on the parasitic elements, introducing an additional resonance associated with length 128 to the antenna. In this way, parasitic elements 124 may serve to increase the bandwidth of antenna 30.

Each antenna 30 in the phased antenna array may be separated from the other antennas in the phased antenna array by vertical conductive structures such as conductive vias 130. Sets or fences of conductive vias 130 may laterally surround antenna 30 (e.g., each antenna in the phased antenna array). Conductive vias 130 may extend through substrate 70 to the underlying ground traces (e.g., ground traces 98, 100, and/or 102 of FIG. 8). Conductive landing pads (not shown in FIG. 9 for the sake of clarity) may be used to secure conductive vias 130 to each layer of substrate 70 as the conductive vias pass through the substrate. By shorting conductive vias 130 to ground traces in substrate 70, conductive vias 130 may be held at the same ground or reference potential as the ground traces. Conductive vias 130 may be separated from one or more adjacent conductive vias by a relatively short distance so as to effectively appear as a solid conductive wall to radio-frequency signals at the frequencies of operation of antenna 30 (e.g., the conductive vias may be separated by one-eighth the shortest effective wavelength of antenna 30, one-tenth the shortest effective wavelength, one-twelfth the shortest effective wavelength, one-fifteenth the shortest effective wavelength, less than one-eighth the shortest effective wavelength, etc.).

As shown in FIG. 9, the antenna radiating element 64 of antenna 30 may be mounted within a corresponding volume 125 (sometimes referred to herein as cavity 125). The edges of volume 125 for antenna 30 may be defined by conductive vias 130 and the underlying ground traces. In this way, conductive vias such as conductive vias 130 and the underlying ground traces may form a conductive cavity for each antenna in the phased antenna array (e.g., each antenna in the phased antenna array may be a cavity-backed antenna having a conductive cavity formed from conductive vias and ground traces). The conductive cavity may serve to enhance the gain of antenna 30 and/or may serve to isolate the antennas in the phased antenna array from each other (e.g., to minimize electromagnetic cross-coupling between the antennas).

The example of FIG. 9 is merely illustrative. The fences of conductive vias 130 may follow any desired lateral outline (e.g., the fences of conductive vias 130 may follow any desired straight and/or curved paths). Patch element 60-3 and parasitic elements 124 may have other shapes (e.g., any desired shapes having any desired number of curved and/or straight edges). If desired, multiple antennas 30 may be mounted within cavity 125 (e.g., antennas for covering different frequency bands).

Figure 10:
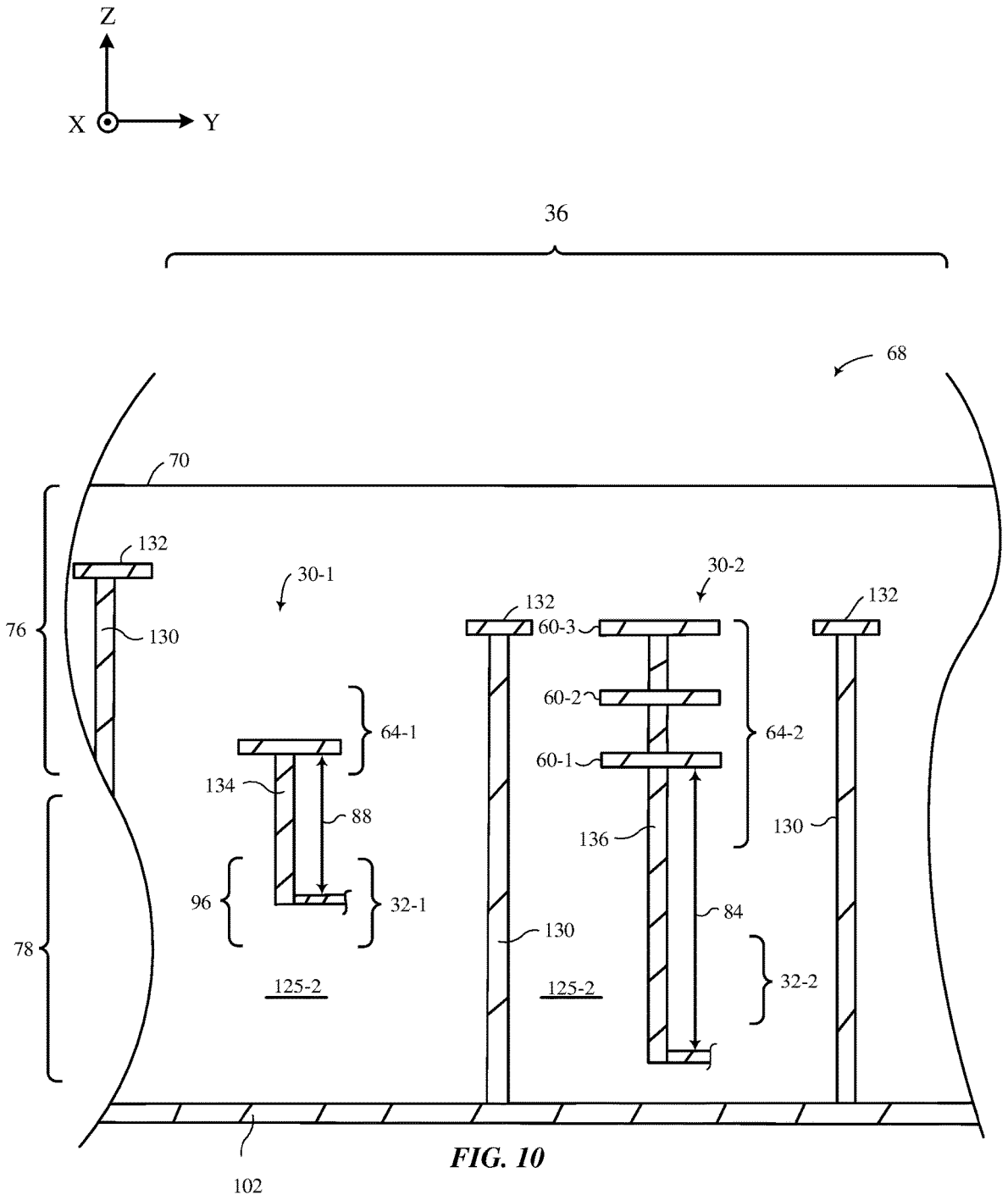
FIG. 10 is a cross-sectional side view of an illustrative phased antenna array having antennas with different numbers of stacked patch elements in accordance with some embodiments.

FIG. 10 is a cross-sectional side view showing how phased antenna array 36 may include multiple antennas having different numbers of stacked patch elements. As shown in FIG. 10, phased antenna array 36 may include at least antennas 30-1 and 30-2 embedded within substrate 70 of antenna module 68. While transmission line layers 78 of substrate 70 may include any desired number of ground trace layers, only ground traces 102 are shown in FIG. 10 for the sake of clarity.

Antenna 30-1 may be coupled to at least a first radio-frequency transmission line path 32-1 in the additional routing layers 96 of transmission line layers 78. Antenna 30-1 may include an antenna radiating element 64-1 coupled to the signal trace in radio-frequency transmission line path 32-1 by conductive via 134. In scenarios where antenna 30-1 is differentially fed, antenna radiating element 64-1 may be coupled to a differential radio-frequency transmission line path in additional routing layers 96 (e.g., a differential radio-frequency transmission line path such as differential radio-frequency transmission line paths 32D of FIG. 6) using multiple conductive vias. Antenna 30-1 may be located within a cavity 125-1 between fences of conductive vias 130 and ground traces 102.

Antenna 30-2 may be coupled to at least a second radio-frequency transmission line path 32-2 in transmission line layers 78 (e.g., dielectric layers of substrate 70 that are located closer to ground traces 102 than additional routing layers 96). Antenna 30-2 may include an antenna radiating element 64-2 coupled to the signal trace in radio-frequency transmission line path 32-2 by conductive via 136. In scenarios where antenna 30-2 is differentially fed, antenna radiating element 64-2 may be coupled to a differential radio-frequency transmission line path in transmission line layers 78 (e.g., a differential radio-frequency transmission line path such as differential radio-frequency transmission line paths 32D of FIG. 6) using multiple conductive vias.

Antenna 30-2 may be located within a cavity 125-2 between fences of conductive vias 130 and ground traces 102. Conductive vias 130 may extend from ground traces 102 (or other ground traces in transmission line layers 78) to conductive landing (contact) pads 132. Conductive landing pads 132 may be coplanar with any desired portion of antenna radiating elements 64-1 and/or 64-2 or may be non-coplanar with antenna radiating elements 64-1 and 64-2.

As shown in FIG. 10, antenna radiating element 64-1 is separated from radio-frequency transmission line path 32-1 by a relatively short distance such as distance 88. Because the signal trace for radio-frequency transmission line path 32-2 is lower than the signal trace for radio-frequency transmission line path 32-1, antenna radiating element 64-2 is separated from radio-frequency transmission line path 32-2 by a relatively long distance such as distance 84. Conductive via 136 may thereby introduce more inductance to radio-frequency transmission line path 32-2 than conductive via 134 introduces to radio-frequency transmission line path 32-1.

Antenna radiating element 64-1 may, for example, include a single patch element coupled to conductive via 134. At the same time, antenna radiating element 64-2 may include multiple stacked patch elements such as patch elements 60-1, 60-2, and 60-3 (e.g., antenna 30-2 may be formed using the structures of antenna 30 of FIG. 8). This may introduce capacitances to antenna radiating element 64-2 (e.g., capacitances C1, C2, and C3 of FIG. 8) that help to compensate for the relatively high inductance associated with conductive via 136 and that thereby serve to match the impedance of antenna 30-2 to the impedance of radio-frequency transmission line path 32-2. In this way, the impedance of antennas 30 in phased antenna array 36 may be sufficiently matched across the array (e.g., without using SMT capacitors) despite feeding the antennas using radio-frequency transmission line paths at different distances from the antenna radiating elements (e.g., as required to feed a relatively large number of antennas in antenna module 68 within a small volume while still exhibiting satisfactory electromagnetic isolation between the radio-frequency transmission line paths).

The example of FIG. 10 is merely illustrative. Conductive vias 130 and conductive landing pads 132 may be omitted. Phased antenna array 36 may include any desired number of antennas having a single patch element (e.g., antennas such as antenna 30-1 of FIG. 10 and antenna 30 of FIG. 6) and any desired number of antennas having multiple stacked patch elements (e.g., antennas such as antenna 30-2 of FIG. 10 and antenna 30 of FIG. 8). Phased antenna array 36 may additionally or alternatively include other antennas having two stacked patch elements or more than three stacked patch elements.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a dielectric substrate;

ground traces on the dielectric substrate;

a radio-frequency transmission line path having a signal trace on the dielectric substrate, the ground traces forming part of a ground conductor for the radio-frequency transmission line path;

an antenna radiating element on the substrate and overlapping the ground traces, wherein the antenna radiating element is operable to convey radio-frequency signals at a frequency greater than 10 GHz and comprises a first patch element, a second patch element overlapping the first patch element, and a third patch element overlapping the first and second patch elements; and a conductive via that extends through the dielectric substrate and connects the signal trace of the radio-frequency transmission line path to the first, second, and third patch elements, wherein the first, second, and third overlapping patch elements exhibit a capacitance at the antenna radiating element for impedance matching with the radio-frequency transmission line path.

2. The electronic device defined in claim 1, wherein the radio-frequency transmission line path comprises a differential radio-frequency transmission line path.

3. The electronic device defined in claim 2, wherein the radio-frequency transmission line path further comprises an additional signal trace on the dielectric substrate, the electronic device further comprising:

an additional conductive via that extends through the dielectric substrate and couples the additional signal trace of the radio-frequency transmission line path to the first, second, and third patch elements.

4. The electronic device defined in claim 3, wherein the conductive via contacts the first, second, and third patch elements at first locations on the first, second, and third patch elements, and the additional conductive via contacts the first, second, and third patch elements at second locations on the first, second, and third patch elements, the second locations being laterally offset from the first locations.

5. The electronic device defined in claim 4, wherein the differential radio-frequency transmission line path comprises a first stripline that includes the signal trace and a second stripline that includes the additional signal trace.

6. The electronic device defined in claim 5, further comprising:

radio-frequency transceiver circuitry having a differential port coupled to the first and second striplines.

7. The electronic device defined in claim 6, wherein the radio-frequency transceiver circuitry is mounted to the dielectric substrate.

8. The electronic device defined in claim 1, wherein the second patch element completely overlaps the first patch element and the third patch element completely overlaps the first and second patch elements.

9. The electronic device defined in claim 1, wherein the antenna radiating element comprises parasitic elements formed from conductive traces coplanar with one of the first, second, and third patch elements.

10. The electronic device defined in claim 1, further comprising fences of conductive vias coupled to the ground traces and extending through the dielectric substrate, wherein the fences of conductive vias laterally surround the antenna radiating element on the dielectric substrate.

11. The electronic device defined in claim 1, further comprising:

a dielectric cover layer, wherein the dielectric substrate is mounted to the dielectric cover layer and the antenna radiating element is configured to convey the radio-frequency signals through the dielectric cover layer.

12. The electronic device of claim 1, wherein the conductive via comprises a first portion that couples the signal trace to the first patch element, a second portion that couples the first patch element to the second patch element, and a third portion that couples the second patch element to the third patch element, and the radio-frequency transmission line path further comprises an additional signal trace on the dielectric substrate, the electronic device further comprising:

an additional conductive via that extends through the dielectric substrate and couples the additional signal trace of the radio-frequency transmission line path to the first, second, and third patch elements, the additional conductive via being laterally offset from the conductive via.

13. The electronic device of claim 1, wherein the conductive via includes a first portion that connects the first patch element to the second patch element, and a second portion that connects the second patch element to the third patch element.

14. The electronic device of claim 1, wherein the radio-frequency transmission line path has an additional signal trace on the dielectric substrate, the electronic device further comprising:

an additional conductive via that extends through the dielectric substrate and connects the additional signal trace of the radio-frequency transmission line path to the first, second, and third patch elements.

15. An electronic device comprising:

a dielectric substrate;

ground traces on the dielectric substrate;

a radio-frequency transmission line path having first and second signal traces on the dielectric substrate, the ground traces forming part of a ground conductor for the radio-frequency transmission line path;

an antenna radiating element on the substrate and overlapping the ground traces, wherein the antenna radiating element is operable to convey radio-frequency signals at a frequency greater than 10 GHz and comprises a first patch element, a second patch element overlapping the first patch element, and a third patch element overlapping the first and second patch elements;

a first conductive via that extends through the dielectric substrate, connects the first signal trace to the first, second, and third patch elements, and comprises a first portion that couples the signal trace to the first patch element, a second portion that couples the first patch element to the second patch element, and a third portion that couples the second patch element to the third patch element; and a second conductive via that extends through the dielectric substrate and couples the second signal trace to the first, second, and third patch elements, the second conductive via being laterally offset from the first conductive via.

16. The electronic device of claim 15, wherein the second conductive via comprises a fourth portion that couples the second signal trace to the first patch element, a fifth portion that couples the first patch element to the second patch element, and a sixth portion that couples the second patch element to the third patch element.

17. An electronic device comprising:

a dielectric substrate;

ground traces on the dielectric substrate;

a first radio-frequency transmission line path having a first signal trace on the dielectric substrate, the ground traces forming part of a ground conductor for the first radio-frequency transmission line path;

a second radio-frequency transmission line path having a second signal trace on the dielectric substrate;

first and second antenna radiating elements on the substrate and overlapping the ground traces, the first antenna radiating element comprising a first patch element, a second patch element overlapping the first patch element, and a third patch element overlapping the first and second patch elements, and the second antenna radiating element comprising a fourth patch element, a fifth patch element overlapping the fourth patch element, and a sixth patch element overlapping the fourth and fifth patch elements, wherein the first and second antenna radiating elements are operable to convey radio-frequency signals at a frequency greater than 10 GHz;

a first conductive via that extends through the dielectric substrate and connects the first signal trace to the first, second, and third patch elements; and a second conductive via that extends through the dielectric substrate and couples the second signal trace to the fourth, fifth, and sixth patch elements.

18. The electronic device of claim 17, further comprising:

a phased antenna array that includes the first and second antenna radiating elements; and control circuitry configured to control the phased antenna array to convey radio-frequency signals within a signal beam oriented at a selected beam pointing angle.

19. The electronic device of claim 18, further comprising:

a fence of conductive vias extending through the dielectric substrate, the fence of conductive vias being laterally interposed between the first antenna radiating element and the second antenna radiating element.

20. An electronic device comprising:

a dielectric substrate;

ground traces on the dielectric substrate;

a radio-frequency transmission line path having a signal trace on the dielectric substrate, the ground traces forming part of a ground conductor for the radio-frequency transmission line path;

an antenna radiating element on the substrate and overlapping the ground traces, wherein the antenna radiating element is operable to convey radio-frequency signals at a frequency greater than 10 GHz and comprises a first patch element, a second patch element overlapping the first patch element, a third patch element overlapping the first and second patch elements, and parasitic elements formed from conductive traces coplanar with two of the first, second, and third patch elements; and a conductive via that extends through the dielectric substrate and connects the signal trace of the radio-frequency transmission line path to the first, second, and third patch elements.

* * * * *